United States Patent [19]

Ballwebber

[11] Patent Number: 4,782,551

[45] Date of Patent: Nov. 8, 1988

[54] APPARATUS FOR CLEANING SURFACES

[76] Inventor: Arnold E. Ballwebber, 19447 Grim Rd. NE., Aurora, Oreg. 97002

[21] Appl. No.: 70,121

[22] Filed: Jul. 6, 1987

Related U.S. Application Data

[63] Continuation of Ser. No. 773,668, Sep. 6, 1985, abandoned.

[51] Int. Cl.[4] ..... A47L 11/00

[52] U.S. Cl. ..... 15/321; 15/322; 239/248; 239/225.1

[58] Field of Search ..... 15/300, 322; 239/225, 239/243, 248, 380

[56] References Cited

U.S. PATENT DOCUMENTS

| | | | |
|---|---|---|---|
| 3,774,262 | 11/1973 | Anthony et al. | 15/322 |
| 3,985,572 | 10/1976 | Petermann et al. | 134/34 |
| 4,333,204 | 6/1982 | Monson | 15/321 |
| 4,353,145 | 10/1982 | Woodford | 15/321 |
| 4,356,590 | 11/1982 | Goldsmith | 15/322 X |
| 4,488,329 | 12/1984 | Lackenbach | 15/322 |

FOREIGN PATENT DOCUMENTS

| | | | |
|---|---|---|---|
| 892658 | 3/1962 | United Kingdom | 15/322 |

*Primary Examiner*—Chris K. Moore
*Attorney, Agent, or Firm*—Charles N. Hilke

[57] ABSTRACT

A cleaning device comprising means for oscillating a manifold upon which is mounted at least one spray nozzle pointed in a generally downward direction. The spray nozzle then oscillates about an axis parallel to the surface to be cleaned. The means for oscillation may be electric (AC or DC), mechanical or hydraulic where the driving motion may be linear, rotational or oscillating. The hydraulic system is driven by the cleaning solution. Brushes or other mechanical devices may be integrated with or attached to the manifold or other areas of the cleaning device. A vacuum manifold is provided to remove cleaning solution and contaminates or dirt.

8 Claims, 1 Drawing Sheet

FIG. 4
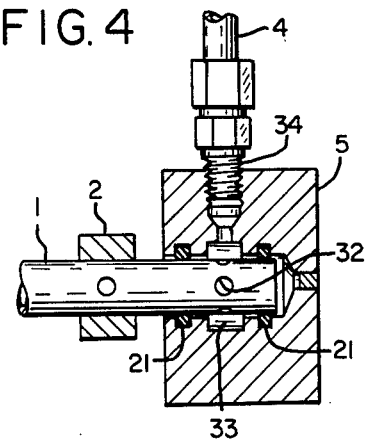
FIG. 1
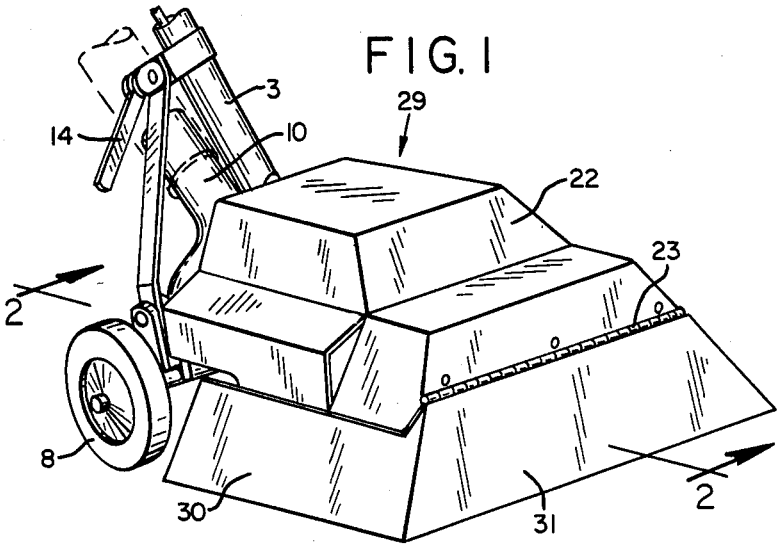
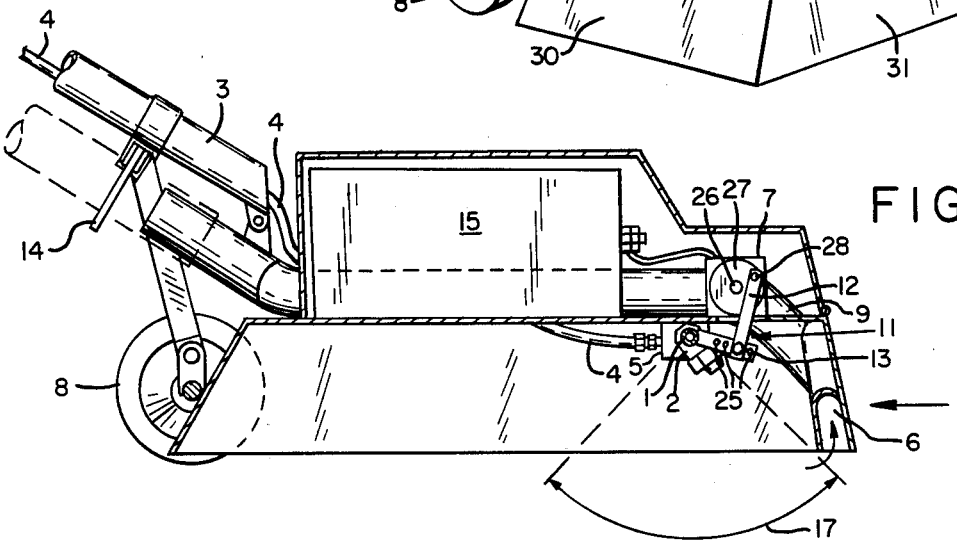
FIG. 2
FIG. 6
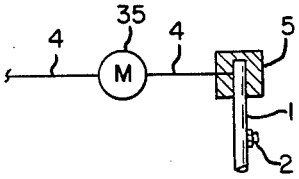
FIG. 3
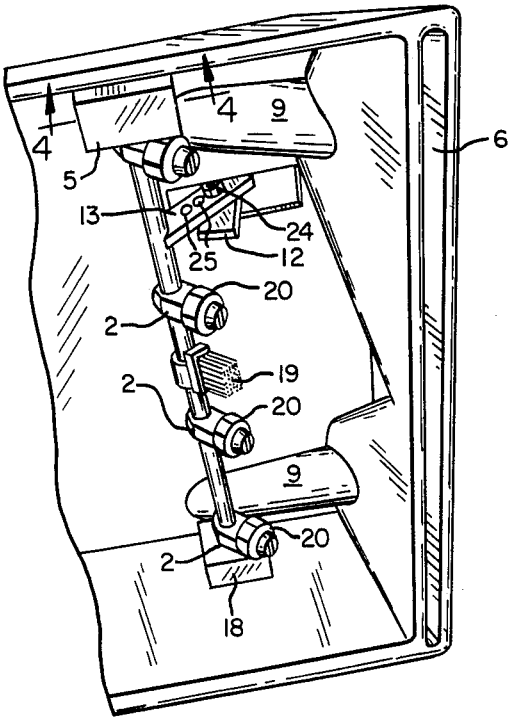
FIG. 5
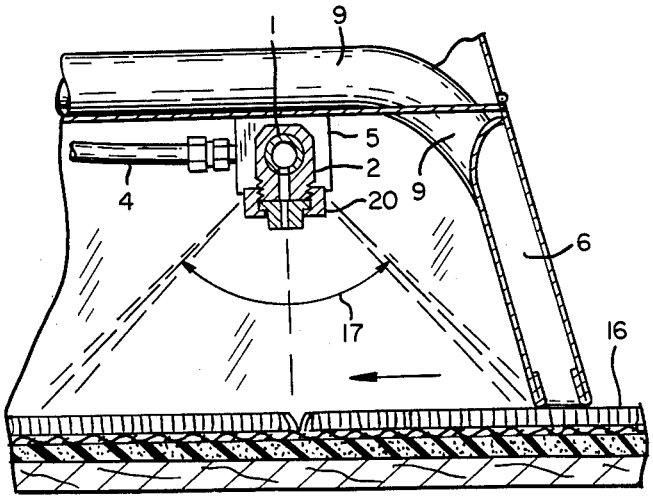

APPARATUS FOR CLEANING SURFACES

This is a continuation of co-pending application Ser. No. 773,668, filed on 9/6/85, now abandoned.

BACKGROUND OF THE INVENTION

1. Field of the Invention

This invention relates to an apparatus and method for cleaning surfaces by use of a cleaning fluid dispersed under pressure by a nozzle. More specifically, this invention relates to an apparatus and method for cleaning surfaces using at least one nozzle, oscillating about an axis parallel to the surface to be cleaned.

2. Background of the Invention

The following constitute known prior art:

| | |
|---|---|
| 2,003,216 | Nadig |
| 2,223,963 | Nadig |
| 2,660,744 | Cockral |
| 3,431,582 | Grave |
| 3,604,169 | Howering |
| 3,614,797 | Jones |
| 3,619,849 | Jones |
| 3,624,668 | Krause |
| 3,774,262 | Anthony |
| 4,191,590 | Sundheim |

Sundheim uses rotation about an axis perpendicular to the surface to be cleaned.

SUMMARY OF THE INVENTION

This invention provides for oscillating nozzles about an axis parallel to the surface to be cleaned. The invention allows cleaning along the "grain" of the surface to be cleaned. For example, carpet fibers are generally attached to a reinforced linear patterned base. The use of the invention allows the movements of the fibers through 180 degrees along the grain upon which they are attached to the rug base. This allows superior cleaning.

The apparatus of the invention uses a manifold to which are attached one or more spray nozzles. The manifold is oscillated through an angle of 100° which provides for sufficient movement of the individual rug fibers. The cleaning fluid is removed through a vacuum manifold. The cleaning fluid and vacuum manifold are powered by a separate power unit not shown. The manifold can include brushes.

It is an object of this invention to provide a superior method for deep cleaning of surfaces.

BRIEF DESCRIPTION OF THE DRAWINGS

FIG. 1 is a prospective view of the entire apparatus.

FIG. 2 is a view along line 2—2 of FIG. 1 showing in cross section the apparatus.

FIG. 3 is a prospective underside view of the apparatus.

FIG. 4 is a cross section view of water pressure line along line 4—4 of FIG. 3.

FIG. 5 is an enlarged view of the front of the apparatus showing a surface to be cleaned.

FIG. 6 is a schematic showing the use of a hydraulic motor.

DETAILED DESCRIPTION OF THE INVENTION

FIG. 1 is a perspective view of the apparatus. The cleaning apparatus 29 has a battery cover 22 hingeably attached to the front cover 31. Side covers 30 are fixably attached to the cleaning device 29. The handle 3 is attached to the device by means of the handle adjustment 14. The handle adjustment 14 is further attached by a pivotable connection to the wheels 8. The central vacuum pipe 10 is attached to a power unit, not shown.

In FIG. 2, a cross sectional view of the cleaning device 29 is shown. The pressure feed tube 4 moves through the hollow handle 3 into and under the battery cover 22. Batteries 15 are wired and attached to a motor 7, which contains a shaft 26 fixably attached to a drive wheel 27. The drive wheel 27 contains a pivot 28 to which is attached a link arm 12. The link arm 12 is attached to the manifold connector 13, which contains adjustment holes 25. The adjustment holes 25 allow for variance of the angle of oscillation 17. The oscillating mechanism 11 is comprised of the shaft 26, drive wheel 27, pivot 28, link arm 12, manifold connector 3 and manifold 1. The spray nozzles 2 are fixably attached to the manifold 1. The vacuum manifold 6 is located directly behind the front cover 31.

FIG. 3 shows an underside perspective view of the cleaning device 29. The vacuum manifold 6 leads to two side vacuum pipes 9. The bearing block 18 and a block made of the material delrin and called a delrin block 5 are shown at either end of the manifold 1. Brushes 19 can be attached to the manifold 1. The spray nozzles 2 are attached and held to he manifold 1 by the nozzle nut 20. Nut 24 attaches the link arm 12 to the manifold connector 13.

In FIG. 4, delrin block 5 is shown in cross section where the pressure feed tube 4 joins the manifold by fitting 34. A spray nozzle 2 is shown. Two O-rings 21 prevent leakage of fluid. The fluid flows into the manifold 1 by means of holes 32 and groove 33 is cut into the delrin block 5 between O-rings 21 and around holes 32.

FIG. 5 shows the cleaning device 29 on a rug 16. The angle of oscillation 17 is clearly shown along with a spray nozzle 2 and nozzle nut 20 attached about the manifold 1. The vacuum manifold 6 is shown leading into one of the side vacuum pipes 9. The fibers of rug 16 positioned directly below the nozzle 2 indicate the movement of fibers first to one side and then to the other side as the nozzle 2 oscillates.

FIG. 6 is a schematic showing the changes necessary to use a hydraulic motor 35. The pressure feed tube 4 is connected to the hydraulic motor 35 before connecting into delrin block 5. The advantage of this embodiment is the elimination of any additional power source other than the power unit which is standard in the industry.

In operation, a high or low pressre power unit (not shown), which is standard in the industry, provides a cleaning solution under pressure to the pressure feed tube 4. The power unit also provides a source of suction to the cleaning apparatus 29, which is attached to the central vacuum pipe 10. This vacuum source attachment is shown in dotted lines in FIGS. 1 and 2. A variable control provides electricity from the batteries 15 to the motor 7. The shaft 26 rotates causing the link arm 12 and manifold connector 13 to move such that the manifold 1 oscillates back and forth through an angle of oscillation 17. The cleaning fluid under pressure moves through the pressure feed tube 4 and the vacuum source begins operation. As the cleaning fluid moves through the pressure feed tube 4, the fluid enters the delri block 5 at groove 33 and through holes 32 and moves under pressure throughout the manifold 1 until exiting through spray nozzles 2. The nozzles 2 are fixably attached to the manifold 1 such that they swing through the angle of oscillation 17.

The cleaning device 29 is then moved in the direction of its handle 3. See FIGS. 2 and 5. The angle of oscillation 17 is adjusted so that the spray always reaches the inside of the vacuum manifold 6. This allows cleaning up to the edge of the surface, for example where the rug meets the baseboard. Note that the angle of oscillation 17 can be varied by attaching the link arm 12 to different adjustment holes 25 on the manifold connector 13. It is generally preferred that the angle of oscillation 17 be about 100 degrees. The rate of oscillation can vary between zero to 2,000 cycles per minute depending upon the setting of the adjustment control. It is preferred that the rate of oscillation be 500 cycles per minute.

While there is not a preferred spray pattern for the nozzles 2, it is preferred that the pressure thorughout the spray pattern be equal for uniform cleaning results. This result is obtained by the use of equal pressure spray nozzles, for example, Spraying System Company's Tee-Jet Model 9502E.

While the invention has been shown using batteries 15 as the power source for the oscillating mechanism, it is clear that alternating current power source can be used for the motor 7 or any other mechanical means, for example, a reciprocating engine. Furthermore, while a specific oscillating mechanism 11 has been described, many other mechanisms can be used. In summary, any combination of power source [i.e. electrical (AC or DC), mechanical or hydraulic], motor output [i.e. rotational, linear or oscillating] and oscillating mechanism [i.e. rotational to oscillating, linear to oscillating, oscillating to oscillating] can be used.

Another preferred embodiment is to eliminate the need for an outside power source by using the pressure within the cleaning fluid to hydraulically drive a motor to provide the oscillation of the manifold 1. This is done by connecting the pressure feed tube 4 to a hydraulic drive motor 35 from which the pressure feed tube 4 then connects to the delrin block 5. The hydraulic drive motor 35 is preferred to be an impeller hydraulic motor. This arrangement eliminates the need for an independent power source to provide the oscillations.

With respect to the method involved, the nozzles oscillate about an axis parallel to the surface to be cleaned. This is particularly important where surfaces have preferred directions of cleaning, for example, a carpet. Most carpets are built upon a linear placement of fibers within a base. This cleaning device allows the fibers to be moved flat against the base in one direction and then flat against the base in the other direction, thus exposing the underlying base to sufficient cleaning fluid. See FIG. 5. Thus, the method of oscillating nozzles in the direction of the grain of the surface to be cleaned constitutes a significant improvement in method. This is accomplished by (1) providing at least one nozzle through which cleaning fluid under pressure will exist towards the surface to be cleaned, and (2) mounting said nozzle such that it oscillates about an axis parallel to the surface to be cleaned and in the same and opposite direction as the movement of the apparatus. Additionally the method involves removing said cleaning fluid from said surface by a vacuum source.

While different embodiments and methods of this invention have been illustrated, it will be understood that those skilled in the art may make changes or other embodiments without departing from the scope of this invention.

I claim:

1. An apparatus for cleaning carpets comprising:

(a) means for supplying cleaning fluid under pressure;

(b) a pressure feed tube interconnected from said means for supplying cleaning fluid under pressure to a delrin block within which is a groove;

(c) at least one hole in a hollow manifold which is positioned in said delrin block to communicate through said groove with said pressure feed tube;

(d) at least one nozzle connected to said manifold so that cleaning fluid can exit through said manifold and said nozzle;

(e) a power source to operate a motor; and (f) an oscillating mechanism connecting said motor's output to said manifold with at least one nozzle where said nozzle oscillates about an axis parallel to the surface to be cleaned and in the same and opposite direction as the movement of said apparatus.

2. The apparatus of claim 1 where said nozzle oscillates at the rate of 500 oscillations per minute.

3. The apparatus of claim 1 where said nozzle provides equal spray pressure throughout the spray pattern.

4. The apparatus of claim 1 where said nozzle's angle of oscillation is variable.

5. The apparatus of claim 1 where said nozzle's spray strikes a vacuum manifold.

6. The apparatus of claim 1 where said nozzles angle of oscillation is 100 degrees.

7. An apparatus for cleaning carpets comprising:

(a) means for supplying cleaning fluid under pressure;

(b) a pressure feed tube interconnected from said means for supplying cleaning fluid under pressure to a delrin block within which is a groove;

(c) at least one hole in a hollow manifold which is positioned in said delrin block to communicate through said groove with said pressure feed tube;

(d) a plurality of nozzles connected to said manifold so that cleaning fluid can exit through said manifold and said nozzles;

(e) a power source to operate a motor; and (f) an oscillating mechanism connecting said motor's output to said manifold with a plurality of nozzles where said plurality of nozzles oscillates about an axis parallel to the surface to be cleaned and in the same and opposite direction as the movement of said apparatus.

8. The apparatus of claim 7 where said nozzles provide equal spray pressure throughout the spray pattern.

* * * * *